US006180150B1

(12) United States Patent
Schäfer

(10) Patent No.: US 6,180,150 B1
(45) Date of Patent: Jan. 30, 2001

(54) PROCESS FOR PACKING FOODSTUFFS WITH A FILM

(75) Inventor: Ekkehardt Schäfer, Karlsruhe (DE)

(73) Assignee: World-Pac International AG, Vaduz (LI)

( * ) Notice: Under 35 U.S.C. 154(b), the term of this patent shall be extended for 0 days.

(21) Appl. No.: 09/106,873

(22) Filed: Jun. 29, 1998

(30) Foreign Application Priority Data

Jul. 11, 1997 (DE) ..... 197 29 659

(51) Int. Cl.[7] ..... A23L 1/317; B65D 81/34

(52) U.S. Cl. ..... 426/410; 426/410; 426/513; 426/105; 426/135

(58) Field of Search ..... 426/105, 92, 138, 426/132, 106, 398, 383, 392, 410, 415, 412, 135, 512–14

(56) References Cited

U.S. PATENT DOCUMENTS

| | | | | |
|---|---|---|---|---|
| 2,105,273 | | 1/1938 | Smith | 493/274 |
| 2,201,457 | | 5/1940 | Smith et al. | 138/118.1 |
| 2,207,793 | | 7/1940 | Freeman | 426/87 |
| 3,369,911 | | 2/1968 | von Witzleben | 138/118.1 |
| 3,378,379 | | 4/1968 | Shiner et al. | 138/118.1 |
| 4,716,713 | * | 1/1988 | Crevasse et al. | 53/530 |
| 4,719,116 | * | 1/1988 | Crevasse | 426/315 |
| 4,883,667 | * | 11/1989 | Alga et al. | 426/420 |
| 4,910,034 | * | 3/1990 | Winkler | 426/420 |
| 5,043,194 | * | 8/1991 | Siebrecht et al. | 426/34.8 |
| 5,049,399 | * | 9/1991 | Huang et al. | 426/87 |
| 5,147,671 | * | 9/1992 | Winkler | 426/140 |
| 5,705,214 | * | 1/1998 | Ito et al. | 426/135 |

FOREIGN PATENT DOCUMENTS

| | | | |
|---|---|---|---|
| 220540 | | 3/1962 | (AT) . |
| 513 595 | | 11/1971 | (CH) . |
| 1 121 503 | | 1/1962 | (DE) . |
| 1 951 899 | | 12/1966 | (DE) . |
| 1 504 982 | | 8/1970 | (DE) . |
| 1 632 103 | | 10/1970 | (DE) . |
| 34 31 578 A1 | | 4/1986 | (DE) . |
| 36 40 234 A1 | | 6/1988 | (DE) . |
| 88 04 123 U1 | | 6/1988 | (DE) . |
| 3907951 A1 | * | 10/1989 | (DE) . |
| 39 30 834 A | | 3/1991 | (DE) . |
| 40 37 055 A1 | | 5/1992 | (DE) . |
| 41 37 658 A1 | | 5/1993 | (DE) . |
| 4320041 A1 | | 12/1993 | (DE) . |
| 42 37 138 A1 | | 3/1994 | (DE) . |
| 43 09 528 A1 | | 9/1994 | (DE) . |
| 4312977 A1 | | 10/1994 | (DE) . |
| 0408164 A2 | * | 1/1991 | (EP) . |
| 0 709 030 A1 | | 5/1996 | (EP) . |
| 0 738 471 A2 | | 10/1996 | (EP) . |
| WO 94 24015 | | 10/1994 | (WO) . |
| 9524835 A1 | * | 9/1995 | (WO) . |

* cited by examiner

*Primary Examiner*—Gabrielle Brouillette
*Assistant Examiner*—Sherry A. Dauerman
(74) *Attorney, Agent, or Firm*—Akin, Gump, Strauss, Hauer & Feld, L.L.P.

(57) ABSTRACT

A packaging film is provided for foodstuffs, wherein the foodstuffs are preferably meat products. The a net is connected to one side of the film to increase resistance to tearing. The net is adhered to the film by a soluble edible adhesive. The film may be shaped into a container wherein the net lies predominantly on an outer side of the container. After filling the film with the foodstuff, the adhesive is dissolved, whereupon the net can be removed without destroying the film.

16 Claims, No Drawings

PROCESS FOR PACKING FOODSTUFFS WITH A FILM

BACKGROUND OF THE INVENTION

The invention concerns a packing film for foodstuffs, especially for meat, sausage or fish products, wherein the film is well suited for consumption, and for increasing resistance to tearing, a net lies on the film.

Such packing films have a wide application and represent a high grade substitute for natural gut. In addition, they are also suited for packing foods which one cannot stuff into natural gut owing to their size or shape. They are generally suited for packing all types of protein-containing foodstuffs, wherein they can enter into a combination with the food protein. Basically, it can be a matter of animal or plant protein.

But the packing films described are not especially resistant to tear. They must therefore, as long as they have not yet joined with the foodstuff protein, be handled carefully or be reinforced by additional measures. A widely used measure for protection of the film consists in surrounding it with a net which is in a position to absorb the weight of the foodstuff and the forces arising during processing.

Thus, for automating sausage manufacture, the sausage mixture, film and net can emerge directly from a double filling tube. But difficulties arise here, in particular when the film is shaped as a tube or the like. Hence, up until today, one cannot reliably guarantee that the edges of the film will overlap uniformly and be sufficiently firmly connected with one another. As a consequence of this, holes or tears can still often occur in this area, from which the meat or sausage filling escapes. The filling then attaches to the net by coagulation and is partly torn out when the net is subsequently removed.

Moreover, the process described is very expensive, regardless of whether the protein film is covered manually or automatically with a net.

SUMMARY OF THE INVENTION

Proceeding from this, underlying the invention is the object of providing providing a packing film and a process for packing foodstuffs of qualitatively high grade, which guarantee good protection for the packed foodstuffs, which are suitable for automation, which permit packing foodstuffs in the most varied forms, and which are economical to produce or implement.

This object is accomplished in accordance with the invention in that the film and the net are no longer applied separately, but are releasably joined with one another by means of an adhesive which is not objectionable according to food law.

Owing to the film and net being fixed to each other, substantial advantages emerge during processing. For one, the film can no longer slide back and forth under the net, and as a consequence of this, can no longer form folds, which can lead to stresses or tears elsewhere. Second, the composite material of film and net can be brought into the desired external shape for the foodstuffs much more easily and without a danger of tearing. Some shapings even become possible for the first time through the composite material, which opens up new, sales-promoting possibilities of presentation. In this connection, net and film should be naturally joined with each other before the film is processed, especially before the foodstuff is filled in.

In addition to the connection property, the dissolubility of the adhesive is crucial for the invention. In this way, the net, which is generally felt to be unaesthetic and disturbing, can be easily removed again after the preparation, cooking or aging process, because then the film is sufficiently held in shape, so that tearing is no longer to be feared.

The separation of net and film could indeed take place simply by mechanically tearing off the net with exact dimensioning of the adhesive action. However, a dissolution or decomposition of the adhesive is advantageous. This can, for example, take place through longer contact with gases or appropriate chemicals. Water is primarily to be recommended as a solvent for reasons of food law. Should other non-objectionable solvents be found in the future, however, these could of course just as well be used.

DETAILED DESCRIPTION OF THE INVENTION

The film should bepermeable to water vapor and oxygen for adequate and qualitatively high grade packing. As materials for the packing come into consideration primarily those materials which combine with foodstuffs, especially with their protein. Protein, starch, modified starch, cellulose, polysaccharide, carrageen, or a mixture of these substances, are mentioned by way of examples. Particularly suitble are polysaccharide films of pullulan, carrageen, genue gum, glycerin, crystalline cellulose, honey wax, alcohol, sugar ester, bean oil, xanthan gum, and water. Suitable formulations include, for example, pullulan—about 0.21%, carrageen—about 2.1%, genue gum—about 2.1%, glycerin—about 1.4%, Avicel RC-30—about 1.12%, honey wax—about 0.07%, alcohol—about 4.0%, water—about 89% (moderately water soluble); or pullulan—about 8.4%, carrageen—about 2.4%, xanthan gum—about 1.2%, Avicel—about 1.96%, sugar ester—about 0.1%, bean oil—about 0.1%, alcohol—about 4.43%, water—about 81.4% (hardly water soluble); or pullulan—about 0.9%, Avicel—about 2.3%, agar—about 8.1%, genue gum—about 0.45%, xanthan gum—about 0.45%, sugar ester—about 0.04%, water—about 88% (only slightly soluble). All indications relate to percent by weight.

Preferably, water insoluble or hardly water soluble film is used, because condensed water arising during cooling cannot separate the film.

By the term "net" is meant any type of material which substantially meets two requirements: First, it must be resistant to tear in order to guarantee the above-mentioned protective property for the film. Second, it should preferably be permeable to air and water vapor, so that the foodstuff can be adequately aged and stored therein.

The net is preferably a coarse or fine meshed fabric, textured (non-woven) or knit, and consists of natural or artificial fibers such as, for example, rayon staple, cotton, polyethylene, polypropylene and/or polyamide.

Especially suitable as adhesives are water soluble adhesives, such as modified starch and/or collagen. Moreover, gelatin-based adhesives are well suited, such as a glue with about 5% to about 30% gelatin, and about 70% to about 95% glycerin, or a glue with about 50% to about 90% alcohol and about 10% to about 50% shellac.

The film together with its net is advantageously joined along at least some of its edges, so that it forms a container, in the simplest case a tube. Through the connection with the net, the film can first of all not only be glued, but can also be sewn or fastened along the edges. This makes possible a substantially more stable connection, whereby numerous new areas of application are opened up to the film.

Finally, the film can be printed for aesthetic reasons or for brand designation. The writing is preferably applied to the inside, for which purpose the film is transparent or clear. As an alternative, however, dyeing the entire film is also conceivable.

Concretely, the process of the invention for packing foodstuffs with the film of the invention can be conceived as follows: First, the film and the net are glued together using an adhesive which is non-objectionable according to food law. There then emerge basically two possibilities for further processing. Either the composite material is shaped into a container by sewing, fastening or gluing, whereby openings for filling, and optionally for ventilation, are left free, and, the net lies at least predominantly on the outside. Afterward, the container is filled with the foodstuff. As an alternative, shaping the container can also take place directly during filling with foodstuff, while this is encased by the film.

After filling, and after aging maturation or heat treatment, or at the end of the manufacturing process, the film has been insolubly joined with the foodstuff, and the net can then be removed once again. This takes place by simply pulling the net off after previously dissolving the adhesive. The dissolution takes place in part owing alone to the condensed water which forms on the packed foodstuffs. In addition, boiling, washing off or showering offer themselves, especially when this is indicated in any case for further processing of the foodstuff. Furthermore, dissolving the adhesive with the aid of a solvent, especially water, has the great advantage that the film has an aesthetically appealing surface without adhesive residues following removal of the net.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

What is claimed is:

1. A process for packing foodstuffs within an edible film and a net which increases the tear resistance of the film, the process comprising releasably adhering the net to one side of the film, such that the net and film are adhered to each other by a liquid soluble edible adhesive, forming a container with the net and the film and filling the film with a foodstuff, wherein the net is adhered to an outside surface of the film facing away from the foodstuff.

2. The process according to claim 1, wherein the foodstuff is selected from the group consisting of meat, sausage and fish products.

3. The process according to claim 1, further comprising shaping the film into a container, such that the net lies predominantly on an outer side of the container.

4. The process according to claim 3, wherein the shaping step is selected from the group consisting of sewing, fastening, and gluing.

5. The process according to claim 1, wherein the adhesive is dissolved after filling the film with the foodstuff.

6. The process according to claim 5, wherein the adhesive is dissolved in water and dissolution takes place by means of boiling or washing off.

7. The process according to claim 1, wherein the net is removed from the film after filling.

8. The process according to claim 7, including further processing of the foodstuff after filling.

9. The process according to claim 1, wherein the film comprises a material selected from the group consisting of cellulose, starch, protein, polysaccharides, codulon, carrageen, and mixtures thereof.

10. The process according to claim 1, wherein the net comprises a textured or knit fabric.

11. The process according to claim 1, wherein the net comprises a material selected from the group consisting of rayon staple, cotton, artificial fibers, and mixtures thereof.

12. The process according to claim 1, wherein the adhesive contains modified starch or collagen.

13. The process according to claim 1, wherein the film is connected along at least some of its edges to form the container.

14. The process according to claim 13, wherein the container is a tube.

15. The process according to claim 13, wherein the connection along the edges is formed by sewing, fastening, or gluing.

16. The process according to claim 1, wherein the film is printed on its inside.

* * * * *